United States Patent [19]

Kammerhofer

[11] 4,148,629

[45] Apr. 10, 1979

[54] PROCESS FOR CONTROLLING A STEEL REFINING PROCESS FOR STEELS HAVING A CARBON CONTENT WITHIN THE RANGE OF 0.1 TO 0.8 % BY WEIGHT

[75] Inventor: Klaus Kammerhofer, Leoben, Austria

[73] Assignee: Vereinigte Osterreichische Eisen- und Stahlwerk-Alpine Montan Aktiengesellschaft, Vienna, Austria

[21] Appl. No.: 819,097

[22] Filed: Jul. 26, 1977

[30] Foreign Application Priority Data

Aug. 4, 1976 [AT] Austria ..... 5782/76

[51] Int. Cl.[2] ..... C21C 5/30

[52] U.S. Cl. ..... 75/52; 75/60

[58] Field of Search ..... 75/52, 60

[56] References Cited

U.S. PATENT DOCUMENTS

| | | | |
|---|---|---|---|
| 3,551,140 | 12/1970 | Nilles | 75/60 |
| 3,594,155 | 7/1971 | Ramachandran | 75/60 |
| 3,619,174 | 11/1971 | Fujii | 75/60 |
| 3,669,645 | 6/1972 | Oishi | 75/60 |
| 3,773,495 | 11/1973 | Nilles | 75/60 |
| 3,832,160 | 8/1974 | Bishop | 75/60 |
| 3,847,593 | 11/1974 | Ramacciotti | 75/60 |

*Primary Examiner*—P. D. Rosenberg
*Attorney, Agent, or Firm*—Cushman, Darby & Cushman

[57] ABSTRACT

Process for controlling a steel refining process for steels having a carbon content within the range of 0.1–0.8 percent by weight, in which the desired final carbon content of the metal bath and the final temperature of the metal bath at the end point of the blowing period are being directly piloted or controlled or headed for, characterized in that the blowing period is being subdivided into three immediately successive stages during each of which the amount of blowing oxygen supplied is maintained constant, thereby selecting the duration of the first blowing period essentially in dependence on the pig iron analysis and on the oxygen flow and making said duration longer with higher Si-and-Mn-content and making said duration shorter with higher oxygen flow, whereupon at the end of this first blowing stage, the oxygen blowing lance is being lowered in an oxygen surface blowing process, noting that all additional materials, such as lime, ore and fluxes, are being added up till the end of this first blowing stage and lime is added in such an amount which, under consideration of the constant oxygen flow at the end of the second blowing period having its duration determined by the oxygen flow and being made shorter with higher oxygen flow, results in saturation of the slag in lime and, respectively, dicalciumsilicate, thereby piloting or heading for a slag basicity of at least 2.8 and a minimum amount of slag of 50 kg/ton of pig iron and maintaining a maximum P-content of 0.04 percent by weight within the crude steel and a minimum Mn-content of 0.2 percent by weight within the crude steel, whereupon in an oxygen blowing process, the lance position is again changed at the end of this second blowing stage, and in that the duration of the subsequent third blowing stage is, under consideration of the constant oxygen flow, selected in dependence on the desired final carbon content and the desired final temperature of the metal bath, noting that for producing steels of higher carbon content refining of the charge is being stopped already during the second blowing stage.

21 Claims, 9 Drawing Figures

Figure 1:
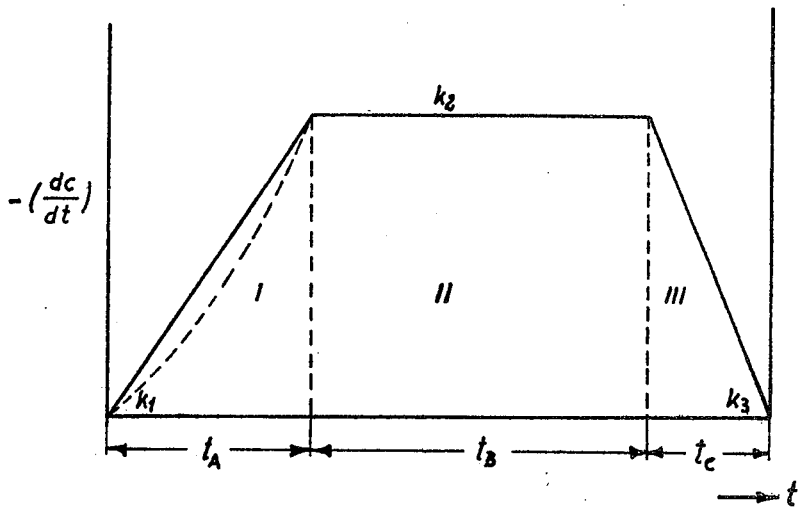

PROCESS FOR CONTROLLING A STEEL REFINING PROCESS FOR STEELS HAVING A CARBON CONTENT WITHIN THE RANGE OF 0.1 TO 0.8 % BY WEIGHT

The present invention refers to a process for controlling a steel refining process for steels having a carbon content within the range of 0.1–0.8 percent by weight, in which the desired final carbon content of the metal bath and the final temperature of the metal bath at the end point of the blowing period are being directly piloted or controlled or headed for. With presently known processes for piloting or controlling a steel refining process, the prescription for the refining vessel, could, with respect to the final carbon content of the metal bath, be met relatively exactly only for low carbon contents. For producing steel qualities having a medium carbon content up to a higher carbon content, the known piloting processes or control processes were in most cases performed such that the metal bathes were first refined to a low carbon content and subsequently the bathes were carburized to the desired final carbon content. This operating mode for producing steels (final carbon content of the metal bath >0.1%), particularly with steels having in the final refined condition a carbon content of (>0.5%) provide only limited possibilities to adjust the desired final carbon content with sufficient reliability and, additionally, results for all ranges of carbon content in a substantial reduction of economy of the refining process (reduced metal output on account of increased slagging of iron, increased wear of the cladding of the refining vessel, increased blowing periods and prolonged charge handling periods aso).

For avoiding the drawbacks resulting by "carburizing" the charge, it has also been tried to interrupt a running refining process at the desired carbon content of the metal bath. This operating mode results, however, in an intolerable inaccuracy when manually controlling the refining process.

It is the main object of the present invention to avoid the mentioned drawbacks and to provide a controlled process with which steels having a carbon content within the range of 0.1 to 0.8 percent by weight are directly obtained and post-treatment operations are avoided. For this purpose, a process of the type described above is, according to the invention, essentially characterized in that the blowing period is being subdivided into three immediately successive stages during each of which the amount of blowing oxygen supplied is maintained constant, thereby selecting the duration of the first blowing period essentially in dependence on the pig iron analysis and on the oxygen flow and making said duration longer with higher Si-and-Mn-content and making said duration shorter with higher oxygen flow, whereupon at the end of this first blowing stage, the oxygen blowing lance is being lowered in an oxygen surface blowing process, noting that all additional materials, such as lime, ore, and fluxes, are being added up till the end of this first blowing stage and lime is added in such an amount which, under consideration of the constant oxygen flow at the end of the second blowing period having its duration determined by the oxygen flow and being made shorter with higher oxygen flow, results in saturation of the slag in lime and, respectively, dicalciumsilicate, thereby piloting or heading for a slag basicity of at least 2.8 and a minimum amount of slag of 50 kg/ton of pig iron and maintaining a maximum P-content of 0.04 percent by weight within the crude steel and a minimum Mn-content of 0.2 percent by weight within the crude steel, whereupon, in an oxygen surface blowing process, the lance position is again changed at the end of this second blowing stage, and in that the duration of the subsequent third blowing stage is, under consideration of the constant oxygen flow, selected in dependence on the desired final carbon content and the desired final temperature of the metal bath, noting that for producing steels of higher carbon content refining of the charge is being stopped already during the second blowing stage. The measures to be taken according to the invention permit, based on a mathematical-analytical process description, a process control in which the control measures essentially comprise the preselection of the end-point of the blowing period at a desired final carbon content of the metal bath, the preselection of a charge-specifically optimum flow of blowing oxygen and its dependence on time during the blowing period, the preselection of the amounts of additive materials required for piloting or aiming at a charge-specifically optimum final composition of the slag, the preselection of the time-sequence for adding the additive materials, the preselection of the amounts of cooling agents required for obtaining the desired final temperature of the metal bath and, in a surface blowing refining process performed with oxygen, the preselection of that lance lowering schedule which is the most effective in the special case considered.

By subdividing the total blowing period into three immediately successive stages, which adjoin one another without any interruption and for each of which apply characteristic properties of the metal bath and of the slag, it becomes possible to select the control measures such that the actual thermodynamic and chemical conditions within the metal bath and within the slag are taken into account in an optimum manner.

According to a preferred embodiment of the process according to the invention the specific flow of oxygen is maintained constant within a range of 150 to 350 $Nm^3/h$ pig iron and the duration of the first blowing stage is, in dependence on the analysis of the pig iron and the oxygen flow, made longer with increasing content in Si and Mn and is being made shorter with increasing specific flow of blowing oxygen.

In a simple manner, the operation is such that the first blowing stage is given a duration according to the equation, $$t_A = \frac{0.62 \cdot 10^3}{VO_2} + 2.75 \cdot Si_R + 0.64 \cdot Mn_R + 0.43,$$

in which $t_A$ is the duration in minutes of the first blowing stage, $VO_2$ is the specific flow of blowing oxygen expressed in $Nm^3/h.t$ pig iron, $Si_R$ is the Si-content in percent of the pig iron and $Mn_R$ is the Mn-content in percent of the pig iron. Adding of the additive materials shall be terminated at the latest after a time interval from starting the blowing process which is increasing with increasing oxygen flow, with increasing oxygen pressure and with increasing inner diameter of the refining vessel and which is decreasing with the nozzle diameter, with the number of nozzles and with the weight of the charge, noting that the instant for terminating the addition of additive materials is being determined according to the following equation, $$T_1 = t_g \cdot \frac{1.2 \cdot 10^2 \cdot v_o \cdot D_T^4}{\sqrt{N^3} \cdot M_{St}^2 \cdot D_{kr} \cdot (-0.275 \cdot p_1^2 + 6.1 \cdot p_1 - 5.5}\,,$$

in which $T_1$ is the maximum duration, measured in minutes from the very beginning of the blowing process, for adding the additive materials, $t_g$ is the total blowing time as measured in minutes, $v_o$ is the flow of the blowing oxygen in $Nm^3/min$, $D_T$ is the inner diameter of the refining vessel as measured in meters, N is the number of nozzles, $M_{St}$ is the amount of crude steel in tons, $D_{kr}$ is the narrowest diameter of the nozzle as measured in millimeters and $p_1$ is the oxygen pressure as measured in atmospheres.

The second blowing stage is being terminated, according to the invention, at a carbon content of approximately $C_{kr}=0.206 \cdot VO_2 0.15$. The duration of the second blowing stage is preferably selected in dependence on the final carbon content aimed at or piloted, noting that the charge is, at a final carbon content of less than the final carbon content being critical for the second blowing stage, being further treated within the third blowing stage after a time interval of $t_B=(C_A-C_{kr})/k_2$, wherein $t_B$ is the duration of the blowing stage, $C_A$ is the carbon content of the metal bath at the beginning of the second blowing stage and $K_2$ is the decarburization velocity in the second blowing stage and expressed in percent by weight per minute, whereas the refining of the charge is, after a time interval corresponding to $t_{B'}=(C_A-C_v)/k_2$ and mesured in minutes, being stopped for a prescribed carbon content ($C_v$) being greater than $C_{kr}$, the indicated time intervals applying from the begin of the second blowing stage, i.e. after the time interval $t_A$ has elapsed. The decarburizing velocity $K_2$ is dependent on the specific oxygen flow and amounts to $K_2=1.35 \cdot 10^{-3} \cdot VO_2$. This decarburizing velocity is, as considered over the whole refining process, the maximum decarburizing velocity. The carbon content at the begin of the second blowing stage is defined by the equation $C_A=C_R-0.465 \cdot K_2 \cdot t_A$, wherein $C_R$ is the carbon content of the pig iron.

If the desired final carbon content of the metal bath is smaller than the carbon content being critical for the transition of the charge from the second blowing stage to the third blowing stage, the duration of the third blowing stage is being selected in dependence on the oxygen flow.

The duration ($t_c$), as measured in minutes, of the third blowing stage is determined in accordance with the following equation $$t_c = \frac{3.277 \cdot 10^2}{VO_2^{0.85}} - \sqrt{\frac{1.0738 \cdot 10^5}{VO_2^{1.7}} - \frac{4.228 \cdot 10^5 \cdot (C_{kr}-C_v)}{VO_2^{1.85}}}$$

In this case, the oxygen flow shall essentially be selected in dependence on the total requirement in oxygen, on the analysis of the pig iron and on the amount of pig iron.

Preferably, the optimum flow of blowing oxygen is for each individual charge determined by the equation $$v_o = \frac{O_g - 5.528 \cdot M_{Re}}{A} + \frac{0.3785 \cdot M_{Re}^{0.85} \cdot v_{om}^{0.15} - C_R \cdot M_{Re}}{9.3 \cdot 10^{-2} \cdot ADVC \cdot A}$$

under the condition $C_v<C_{kr}$ and determined by the equation $$v_o = \frac{O_g - 5{,}528 \cdot M_{Re}}{A} + \frac{(C_v - C_R) \cdot M_{Re}}{9.3 \cdot 10^{-2} \cdot ADVC \cdot A}$$

under the condition $C_v>C_{kr}$, wherein $O_g$ is the total requirement of oxygen, $M_{Re}$ is the amount of pig iron, $$A=1.471 \cdot Si_R+0.342 \cdot Mn_R+0.23 \text{ and } v_{om}=\frac{v_{omin}+v_{omax}}{2}$$

noting that $v_{omin}$ and $v_{omax}$ are the plant-specific limiting values for the flow of blowing oxygen and ADVC is an adaptation factor, by which, in a surface blowing refining process performed with oxygen, the effective decarburization velocity ($K_2$) in the second blowing stage is being considered in dependence on the lance position.

In a surface blowing refining process performed with oxygen, also the lance position is changed in dependence on the individual blowing stages at the end of each individual blowing stages, noting that the lance position is selected during the first blowing stage according to the equation $$L_1=D_{kr}\sqrt{N} \cdot (-0.275 \cdot P_1^2+6.1 \cdot p_1-5.5) \cdot 10^{-3}$$

in which $L_1$ is the distance from the bath surface as measured in meters, and $D_{kr}$, N and $P_1$ have the above defined meanings, and noting that the lance is being lowered at the beginning of the second blowing stage to a distance which is being selected to dependence on the oxygen flow, the inner diameter of the refining vessel, the number of nozzles, the weight of the bath and the amount of the slag. For this purpose, the operation is preferably such that the lance position is selected at the beginning of the second blowing stage according to the equation $$L_2 = \left(-\frac{p}{2} + \sqrt{\left(\frac{p}{2}\right)^2 - q}\right) \cdot 10^{-2} \quad m$$

$$p = \frac{20 \cdot \sqrt{M_{St}}}{D_T} - 6 \cdot \sqrt{\frac{v_o}{N}}$$

$$q = \frac{10^2 \cdot M_{St}}{D_T^2} - \frac{60}{D_T} \cdot \sqrt{\frac{M_{St} \cdot v_o}{N}} + \frac{9 \cdot v_o}{N} - \frac{25 \cdot \frac{v_o}{N}}{\frac{0.05}{D_T} \cdot \sqrt{M_{St}} + \frac{M_{Sl} \cdot 0.12}{D_T^2}}$$

in which $M_{Sl}$ is the amount of slag in tons and the remaining variables have the meanings defined above.

At the beginning of the third blowing stage, the lance position is again changed and, starging from the lance position used in the second blowing stage, raised or lowered for a certain distance in dependence on the final carbon content, on the specific oxygen flow, on the weight of the bath and on the inner diameter of the refining vessel. Thus, preferably the lance is raised or lowered at the beginning of the third blowing stage for a distance $$\frac{1{,}43.10^3 \cdot (C_{kr} - C_v)^{1{,}34}}{v_{O_2}{}^{0{,}96} \cdot \frac{M_{St}}{D_T{}^2}}$$

as expressed in meters. The lance may be raised when producing medium carbon steels, whereas the lance is being lowered when producing low carbon steels.

In the following, the invention is further illustrated with reference to the drawing illustrating in principle the refining process.

In the drawing

Figure 2:
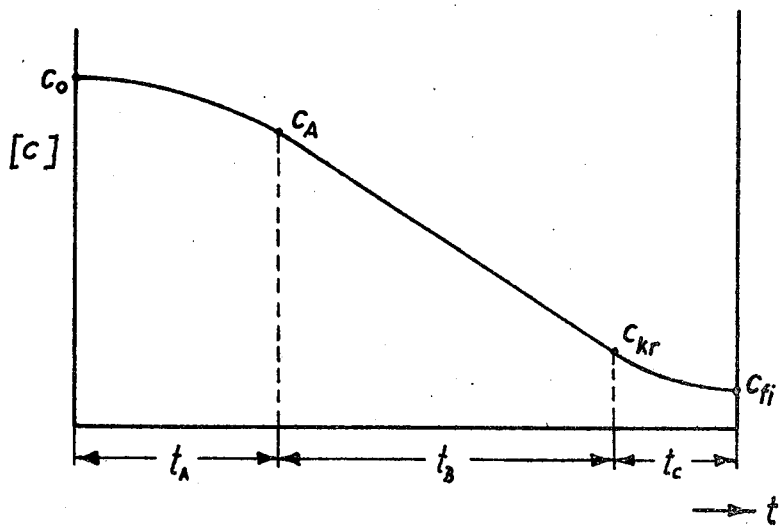
Figure 3:
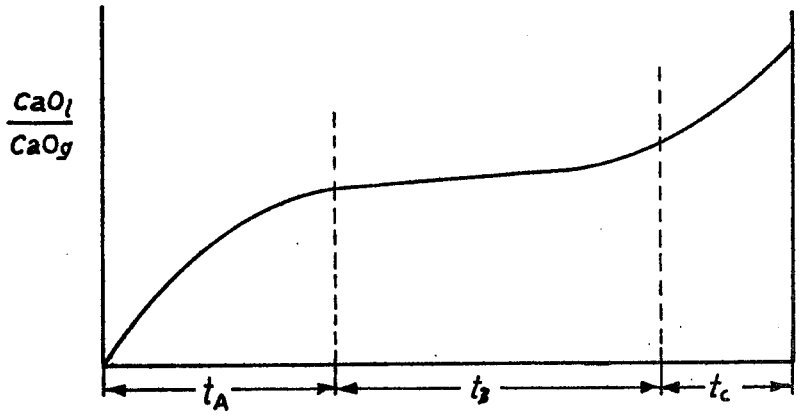
Figure 4:
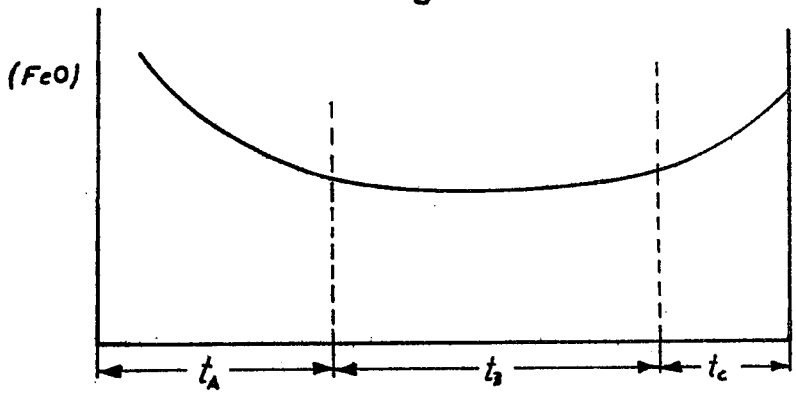
Figure 5:
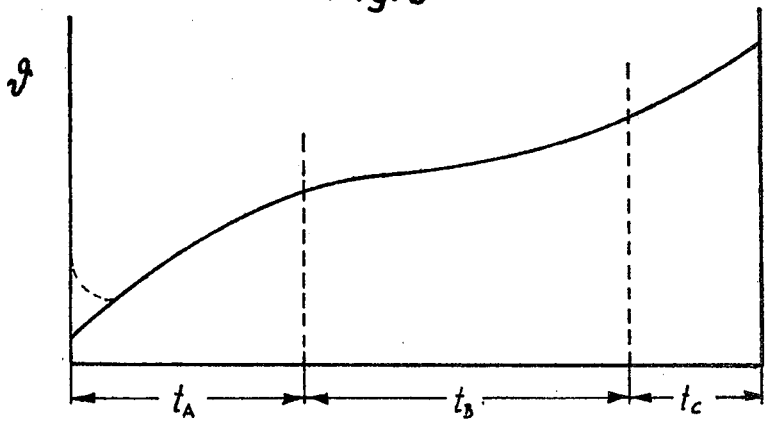
Figure 6:
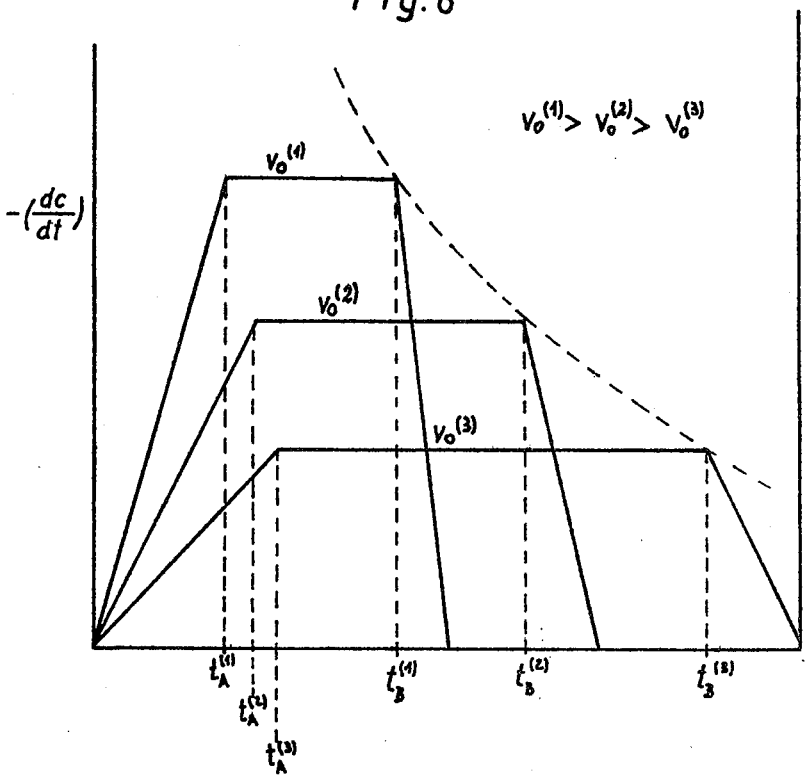
Figure 7:
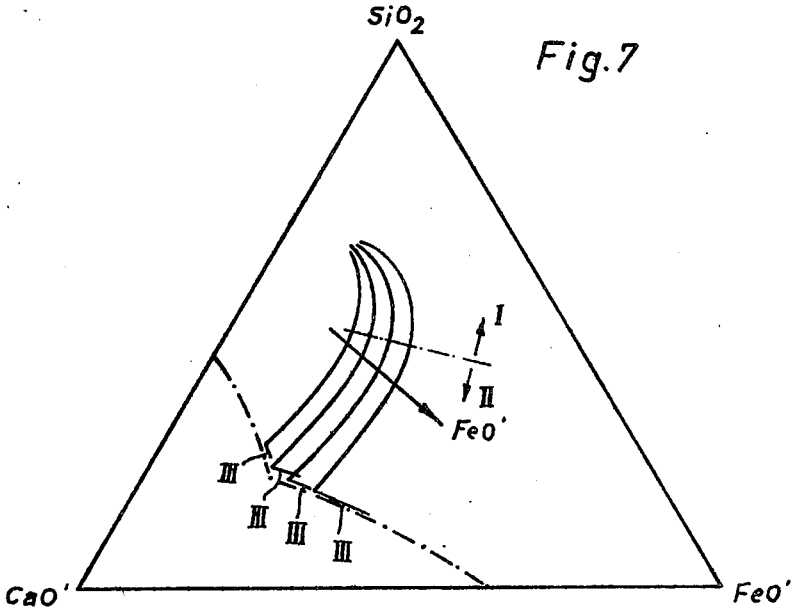
Figure 8:
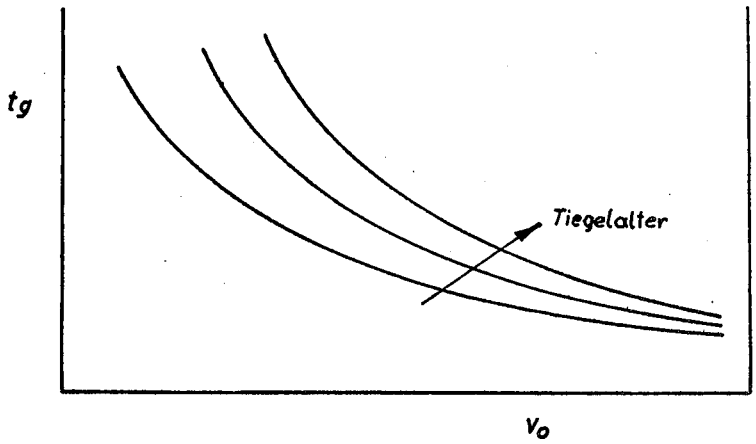
Figure 9:
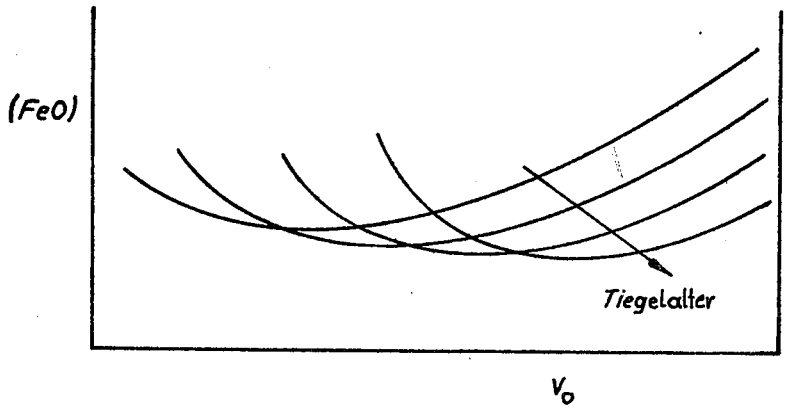

FIG. 1 illustrates the variation of the decarburizing velocity in dependence on the blowing time, FIG. 2 illustrates the variation of the carbon content in dependence on the blowing time, FIGS. 3 and 4 illustrate the dependence on the concentration of typical slag components in dependence on the blowing time, FIG. 5 illustrates the dependence of the bath temperature on the blowing time, FIG. 6 illustrates the dependence of the decarburization velocity on varying oxygen flows FIG. 7 illustrates the schematical course of various slag concentration paths within the quasi-ternary system $(CaO)'-(FEO)'-(SIO_2)'$, FIG. 8 illustrates the dependence of the total blowing time on the flow of blowing oxygen and FIG. 9 illustrates the dependence of the concentration of FEO within the slag on the flow of blowing oxygen.

The main object of blowing stage I is, beside a complete oxydation of Si, piloting of or heading for the required slagging of Mn and P and formation of a liquid slag of defined FeO-content in a sufficient amount and a corresponding dissolution of lime. Thus, the object of the process control according to the invention is to pilot, based on the FeO-content required for the required slagging of Mn and P, the slag composition existing at the end of the first blowing stage near to the range of saturation in lime, in which range, in view of the maximum activity of CaO, are encountered the most favorable refining conditions from a matallurgic and economic standpoint. For this first blowing stage, the decarburization acceleration $k_1$ (%/min$^2$) is characteristic, which is a function of the contents of the pig iron in Si and Mn, of the $v_o$, of the lance distance, of the dissolution of lime and of the $\theta$ RE (RE = pig iron).

During the blowing stage II, within which maximum decarburization occurs, the surface blown oxygen is nearly completely consumed for oxidizing carbon, noting that the decarburization velocity is mainly dependent on the specific oxygen volume (= oxygen flow/to of pig iron) supplied during the unit of time. In view of the FeO-content of the slag remaining essentially constant within this blowing stage, further dissolving of the lime added becomes markedly slowed down. Thus, it becomes a further object of the process control during this blowing stage to reach as soon as possible the condition of saturation in lime of the slag present within the refining vessel and to completely dissolve the added amount of cooling agents. In this case, the velocity constant $k_2$(percent/min) is essentially a function of $v_o$, $M_{RE}$ and the lance distance.

Beginning with a charge-specific carbon content ($C_{kr}$) of the bath, the blowing stage III is being initiated in which the oxydation rate for the carbon is mainly determined by the carbon diffusion and no more by the direct oxydation of carbon by the blowing oxygen supplied, i.e. that only part of the blowing oxygen is used for oxydizing carbon and that the remainder of the oxygen supplied results in an oxydation of iron which is accompanied by an increased dissolution of the lime and a more rapid temperature increase of the steel bath. The problem to be solved within this blowing stage is to minimize the burn-off looses resulting from the oxydation of iron of the metal bath and to simultaneously exactly adjust the prescribed values for the final carbon content of the metal bath and for the final temperature of the metal bath. The decarburization deceleration $k_3$(%/min$^2$), which is characterizing this third blowing stage, again is a function of $v_o$, $M_{RE}$, and the lance distance. $v_o$ is the amount of blowing oxygen supplied, as measured in Nm$^3$/time. The control measures to be taken according to the invention for "catch charges" (i.e. charges for which oxygen supply, and, therewith, refining has been stopped already at a higher carbon content of the metal bath) result from the characteristic course of the refining process and comprise, beside the preselection of the amounts of the start materials, the preselection of the end-point of the blowing period, the preselection of the time-dependence of the flow of the blowing oxygen, the preselection of the time-dependence of the lance position (in a surface blowing refining process operated with oxygen) and the preselection of the time-sequence for adding the additive materials.

The calculation strategies, which are the basis for the control measures, can be distinctly differentiated according to the required final carbon content $C_v$ of the metal bath:

$$C_v > C_{kr} \qquad \text{I}$$

$$C_v < C_{kr} \qquad \text{II}$$

I: For final carbon contents being greater than the characteristic "critical" carbon content, the following calculating operation results:

slag balance
iron balance, oxygen balance and heat balance
optimizing of $v_o$
lowering sequence of the lance
sequence for adding the additive materials II: The calculation operation is the following for final carbon contents being smaller than the critical carbon content:

slag balance
iron balance, oxygen balance and heat balance
correction of the oxygen balance
optimizing of $v_o$ (I+II)
correction of the slag balance, the iron balance, the oxygen balance and the heat balance
optimizing of $v_o$ (III)
lance lowering schedule
sequence for adding the additive materials The starging point used for the calculations is the condition of the slag present in the refining vessel, for which the saturation in lime and, respectively, in dicalciumsilicate, is aimed at and which condition is determined by the required slagging of Mn and P.

$$\text{slag composition}_{(II)} = f[\text{saturation in lime, FeO}(\Delta Mn, \Delta P)]$$

The schematic course of the slag concentration paths within the quasi-ternary system (Cao)'—(FeO)'—(SiO$_2$)' is shown in FIG. 7.

The amount of lime having become dissolved results, under consideration of the time-dependent dissolution of the lime, according to $$C_v < C_{Kr}\ KA_{(C_v)} = KA_{Kr} + \frac{KA_{Fi} - KA_{Kr}}{(C_{Kr} - C_{Fi})^2} \cdot (C_{Kr} - C_v)^2 \text{ (kg/to)} \quad \text{(a)}$$

$$C_v > C_{Kr}\ KA_{(C_v)} = KA_{Kr} \text{ (kg/to)} \quad \text{(b)}$$

$KA_{(C_v)}$ ... specific dissolved lime addition ($C_v$)

$KA_{Fi}$ ... specific dissolved lime addition ($C_v = C_{Fi}$) ($CaO_{min} * \phi Fi$)

$KA_{Kr}$ ... specific dissolved lime addition ($C_v = C_{Kr}$) ($CaO_{min} * \phi Kr$)

$C_{Kr}$ ... carbon content of the bath at the begin of blowing stage III (%)

$C_{Fi}$ ... carbon content of the bath for $\frac{dc}{dt} \longrightarrow 0$ ($C_{Fi} = 0.05$) %

$C_v$ ... nominal final carbon content (%)

$\phi Fi$' $\phi Kr$ ... ratio of dissolved lime to added lime for $C_v = C_{Fi}$ or $C_v = C_{Kr}$, respectively $CaO_{min}$ ... metallurgically minimum required lime addition calculation is Kr.

Because the exact value of $C_{Kr}$ can only be determined after having obtained the optimum value for $v_o$, the calculation is effected with the value $KA_{Kr}$, thereby making the assumption $C_v > C_{Kr}$: Later occurring deviations are being considered in a correction of the slag balance.

The subsequent balances (iron balance, oxygen balance, heat balance) are calculated in a first approximation by assuming that $C_v > C_{Kr}$, i.e. that at the end of the refining process that slag analysis and amount of slag is present which has been calcuated in the slag balance.

By means of the value for the total requirement in blowing oxygen as has been determined in the manner indicated, optimizing of the oxygen flow for the blowing stages I and II is being aimed at. The conditions are illustrated by FIG. 6. The following relations apply.

$$t_{tot}^{(1)} = \frac{O_{tot}}{v_o} \text{ min}$$

$$t_{tot}^{(2)} = t_A + t_B \text{ min}$$

$$t_A = f(k_1)$$

$$t_B = f(t_A, k_2, f^*, C_{Kr})$$

condition to be fulfilled:

$t_{tot}(1) \overset{!}{=} t_{tot}(2)$ ; met by varying $v_o$ $O_{tot}$ ... requirement according to O$_2$-balance (Nm$^3$)

$v_o$ ... O$_2$- flow (Nm$^3$/min)

$k_1, k_2, t_A, C_{Kr}$ ... parameter for carbon burn-off $f^*$ ... factor for considering the deviation from linearity $\frac{dc}{dt} \longleftrightarrow t$ in blowing stage -continued $t_B$ ... blowing period in blowing stage II min By optimizing the oxygen flow (blowing stage I + blowing stage II) according to the invention, it is warranted that beside the desired decarburization also that slag composition in blowing stage II (particularly the FeO-content) is being headed for, which results in the desired slagging of Mn and P (slagging of P has the priority).

If the nominal final carbon content exceeds the carbon content characterizing the end of the blowing stage II ($=C_{Kr}$), optimizing of $v_o$ has been finished; otherwise, the loop [$v_o$(I+II) — optimizing $\rightleftarrows$ correction of iron balance, oxygen balance and heat balance] must be repeatedly run through for achieving a sufficient approximation.

For final carbon contents being smaller than $C_{Kr}$ the optimum flow of blowing oxygen must be headed for or piloted also for the respective blowing period III. The blowing oxygen supplied during the blowing period III is only partially consumed in the decarburization reaction decreasing in reaction velocity, and a substantial portion of this oxygen simultaneously results in an oxydation of iron. This is illustrated in the FIGS. 1 and 4.

As can be derived from FIG. 8, the blowing periods can be shortened by increasing the amounts of oxygen supplied. However, this effect becomes increasingly diminished because the increase of the velocity of the bath reaction does follow the increase of velocity of the oxygen stream only in an attenuated manner. Additionally, at a lower or higher oxygen flow than a certain oxygen flow, increased output losses are to be expected on the ground of an increased burn-off of iron which then enters the slag. This is illustrated by FIG. 9.

An optimum flow of blowing oxygen during the blowing period III must therefore result in an economically reasonable compromise between blowing period and output.

condition to fulfill: $v_0 * t_c - \Delta O_2(\Delta C)$ — minimum; met by varying $v_o$ $v_o$ ... O$_2$ flow (Nm$^3$/min)

$t_c$ ... blowing time in blowing stage III (min)

$\Delta O_2$ ($\Delta C$) ... O$_2$ requirement for ($C_{Kr} \longrightarrow C_v$) Nm$^3$ for the corresponding correction, the slag balance, the iron balance, the oxygen balance and the heat balance must be actualized anew.

After having fixed the starting parameters of the refining process [amounts of charging material, oxygen flow (t)] control measures must be established for the time-dependent change of the position of the lance and for the additon sequence of the additive materials so that a trouble-free and metallurgically optimal process performance is being assisted.

Control of the lance position during blowing stage I shall, in combination with suitable additions of additive materials (fluxes), effect a rapid formation of FeO and, therewith, a rapid dissolution of the lime and a sufficient liquification of the slag and a delay action on carbon burn-off without too severe a disequilibrication. Operation experience for this blowing stage shows that a lance distance corresponding to the core length of the supersonic oxygen jet is a measure for a trouble-free operation. Further important influencing quantities are the following: The analysis of the pig iron, the manner of adding lime, fluxes and cooling agents and the operating age of the refining vessel.

During the blowing stage I a controlled foaming of the slag shall be initiated, noting that slagging of Mn and P, shall, prior to the main decarburizing reaction, be substantially terminated.

| |
|---|
| $L_{(I)} = f(n, v_o, d, W, p)$ m |
| $L_{(I)}$ ... distance of the lance from the bath during blowing stage I |
| n .. number of nozzles |
| $v_o$ .. $O_2$-flow |
| p ... $O_2$-pressure |
| d ... inner diameter of refining vessel |
| w ... weight of steel |

When, at the begin of the blowing stage II, the main decarburizing reaction is initiated, the slags tend to increased foaming on account of an increased amount of CO produced. To avoid the foam from flowing out of the refining vessel, the distance between the lance and the bath must be reduced and foaming of the slag must be controlled to be maintained within tolerable limits, noting that foaming must not be suppressed to such an extent that the metal bath becomes sprayed.

| |
|---|
| $L_{(II)} = f(n, v_o, d, T)$ m |
| $L_{(II)}$ ..... distance of the lance from the bath in the blowing stage II |

Additional measures consist in adding additive materials which result in an increase of the viscosity of the slag phase.

| |
|---|
| $Z_{(II)} = f(L_{(II)})$ |
| e.g. $Z_{(II)}$ .... instant of adding additive materials for reducing the viscosity of the slag |

During the blowing stage III, there can be, according to the required final carbon content, distinguished between "soft blowing" ("Weichblasen") and "hard blowing" ("Hartblasen"), which means that the slag has a lower or a higher viscosity, respectively. Parameters to be considered are the burn-off losses by iron oxydation and forced decarburization to low final carbon contents.

The piloting of the refining process, being based on continuously actualizing the piloting process by adaptive possibility to further development, allows to maintain an optimum piloting strategy irrespective of short-timed or long-timed variations of the refining process.

Realization of the control process according to the invention with respect to optimum time expenditure is warranted by designing the process for the use of digital process-computers.

In the following the present invention is further illustrated by a non-restrictive example, working according to a surface blowing process performed with oxygen.

EXAMPLE:

| | | |
|---|---|---|
| Prescriptions for the refining vessel | Carbon | 0.35% |
| | Manganese | 0.3% |
| | Phosphorus | max. 0.04% |
| | Sulfur | max. 0.04% |
| | Temperature | 1600° C. |

-continued

| | | |
|---|---|---|
| | Amount of Steel | 121 to |
| Pig Iron: | Carbon | 4.3% |
| | Silicon | 0.41% |
| | Manganese | 1.15% |
| | Phosphorus | 0.105% |
| | Sulfur | 0.05% |
| | Temperature | 1259° C. |

1. In view of the prescription for phosphorus being uncritical, the prescription for manganese is the criterion for piloting or heading for the minimum required FeO-content of the slag in blowing stage II.

$$FeO\ (\Delta Mn) = 17.1\% \text{ at a final Mn-content } 0.3\% \quad (1a)$$
$$\text{final P-content} = 0.017\% \quad (1b)$$

2. The slag composition for the quasi-ternary system and resulting in blowing stage II is, when saturation in lime has been aimed at or headed for, the following:

| | | | |
|---|---|---|---|
| $(CaO)'$ | = | 58.1 % | (2) |
| $(FeO)'$ | = | 24.3 % | |
| $(SiO_2)'$ | = | 17.6 % | |

3. The detailed slag balance provides the specific amount of slag per ton of pig iron according to $$MSL_{sp} = 85.7 \text{ kg/to pig iron} \quad (3)$$

4. The calculated final composition of the slag in blowing stage II is, with consideration of all charging materials, the following:

| | | | |
|---|---|---|---|
| CaO | = | 40.9 % | (4) |
| FeO | = | 17.1 % | |
| $SiO_2$ | = | 12.4 % | |
| $Fe_2O_3$ | = | 6.9 % | |
| MnO | = | 14.8 % | |
| MgO | = | 3.6 % | |
| $P_2O_5$ | = | 2.5 % | |
| $Al_2O_3$ | = | 0.9 % | |
| sum | = | 99.1 % | |

The charge-specific proportion of the sum ($CaO + FeO + SiO_2$) is 70.4 percent. The basicity of the slag is 3.3.

5. As the first controlling quantity or piloting quantity for piloting or heading for the final slag in the blowing stage II, the specific amount of lime per ton of pig iron is being calculated with consideration of the dissolution performance of the line and under the assumption $C_v > C_{Kr}$, according to $$M\ lime_{sp} = 65 \text{ kg/to pig iron} \quad (5)$$

6. When calculating the sulphur balance, there results a final sulphur content of $$S_v = 0.031\ \%. \quad (6)$$

7. During the subsequent balancing portion of the charge model, there are calculated the material balances, particularly the iron balance and the oxygen balance, and the heat balance, thereby considering all charging materials at the exact slag balance. There was also considered that according to the standin operating practice there were to be used,

| | | |
|---|---|---|
| fluor spar | 200 kg | (8) |
| granulated slag | 1000 kg | |
| solid pig iron | 4000 kg | |

8. The iron balance provides the specific iron input/ton pig iron (iron losses and scrap substracted) which remains within the bath, and this with the assumption $C_v > C_{Kr}$.

$$Fe^*_{in} = 922 \text{ kg/to pig iron} \quad (8)$$

9. The oxygen balance provides the specific, metallurgically required amount of blowing oxygen with the assumption $C_v > C_{Kr}$ as follows $$O_{2sp} = 56.65 \text{ Nm}^3 / \text{ to pig iron} \quad (9)$$

10. The heat balance provides that excess of heat which is, with the assumption $C_v > C_{Kr}$ to be compensated by cooling agent as follows, $$\Delta Q = 98127 \text{ kcal/to pig iron.} \quad (10a)$$

When working with mill scrap (recycle scrap), there results a specific amount of scrap to be supplied according to $$MSC_{sp} = 285.1 \text{ kg/to pig iron} \quad (10b)$$

11. Since the total iron input remaining within the bath is the total amount of pig iron ($M_{PI}$) is $$FE_{in} = 1207.1 \text{ kg/to pig iron,} \quad (11a)$$

$$M_{PI} = 100.2 \text{ to.} \quad (11b)$$

12. Now the total amounts of scrap, lime and blowing oxygen can be calculated. These amounts are the following,

| | | | | |
|---|---|---|---|---|
| scrap | MSC | = | 28.7 to | (12a) |
| lime | MKS | = | 6540 kg | |
| blowing oxygen | $VO_2$ | = | 5700 $Nm^3$ | |

These control quantities or piloting quantities represent the result of a "static" analysis of the refining process. To attain the desired final carbon content at the end of the refining process, also recognitions on the dynamics of the refining process must be considered within the scope of the present invention.

13. The flow of oxygen is now piloted according to the invention for the blowing stages I and II. This oxygen flow can be calculated by using the optimizing condition $$t^{(1)}(I + II) = t^{(2)}(I + II)$$

which results in the equality of those blowing intervals which result from a static view and a dynamic view of the refining process.

$$v_o^*(I + II) = 480 \text{ Nm}^3/\text{min} \quad (13a)$$

The correlated characteristic values of the decarburization velocity during blowing stage II as well as of the critical content for the transition from blowing stage II to blowing stage III, i.e. the values $k_2$ and $C_{Kr}$, respectively, are $$k_2 = 0{,}446\%/\text{min}$$
$$C_{Kr} = 0{,}481\% \quad (13b)$$

For a desired final carbon content $> C_{Kr}$, optimizing of the flow of blowing oxygen might be stopped, because the blowing period does only comprise the blowing stages I and II; the remaining control measures or piloting measures are concerned with the lance position and the time-sequence of adding the additive materials.

14. In view of the calculations shown in the above items 1 to 12 having been effected with the assumption $C_v > C_{Kr}$ and in view of having obtained as a result that the desired final carbon content of 0.35 percent can be reached only in blowing stages III ($C_{Kr}$ =0.481 percent), the oxygen balance must be corrected for finally optimizing the blowing stages I and II in a corrective balance.

$$\Delta O_2 = f(\Delta C(C_{Kr} \rightarrow C_v)) \quad (14)$$

Based on the equations,

| | | | |
|---|---|---|---|
| $v_o(I + II)$ | = | $f(VO_2 t_A, t_B)$ | (14 b) |
| $k_2$ | = | $f(v_o(I + II))$ | |
| $C_{Kr}$ | = | $f(k_2)$ | |
| $V_{O2}$ | = | $f(\Delta O_2(\Delta(C_{Kr} - C_v))$ | |

the optimized value for $v_{o(I+II)}$ is established according to an iteration method which provides, in the present case, a final value of

| | | | |
|---|---|---|---|
| $v_o(I + II)$ | = | 375 $Nm^3$/min | (14 c) |
| $VO_2$ (I + II) | = | 5570 $Nm^3$ | |
| t (I + II) | = | 14.85min | |

15. The criterion for optimizing the blowing stage II according to the invention is an as high as possible efficiency of the blowing oxygen with respect to the decarburization reaction so that iron losses due to iron burn-off are being kept low. The optimized value for the flow of the blowing oxygen is, under the boundary conditions $$v_{o(III)} \cdot t_c - \Delta O_2(\Delta C) \rightarrow \text{Minimum}$$

calculated according to the following equations

| | | | |
|---|---|---|---|
| $v_{o(III)}^*$ | = | 390 $Nm^3$/min | (15 a) |
| $t_c$ | = | 0.38 min | (15 b) |

16. In view of the simultaneously occurring iron burn-off of 90 kg resulting in an additional amount of FeO of 115 kg, the effect on the slag balance, the iron balance, the oxygen balance and the heat balance for blowing stage III must be considered in a corrective calculation of the balances. Additionally, the changed dissolution performance of lime has also to be considered.

| | | | |
|---|---|---|---|
| MKA | = | $f(MKA^{(1)}, \Delta MKA_{CKr \rightarrow Cv})$ | (16) |
| $Fe_{Ein}$ | = | $f(Fe_{Ein}^{(1)}, \Delta Fe(\Delta FeO_{CKr \rightarrow Cv})$ | |
| $VO_2$ | = | $f(VO_2^{(1)}, \Delta O_2(\Delta FeO_{CKr \rightarrow Cv})$ | |
| ΔSL | = | f(ΔMKA, ΔFeo) | |

-continued

| | | |
|---|---|---|
| MSC | = | $f(\Delta Q^{(I)}, \Delta Q(FeO_{CKr \rightarrow Cv}), \Delta Fe, \Delta SL)$ |

$MKA^{(I)}$, $Fe_{Ein}^{(I)}$, $VO_2^{(I)}$, $\Delta Q^{(I)}$ constant balance components for the blowing stage (I+II)
ΔMKA change in the amount of CaO in the slag in view of increased solubility of the lime in the blowing stage III (>0)
ΔFe change in iron burn-off by oxydation of the iron during the blowing stage III
$\Delta O_2$ change in the oxygen requirement in view of the oxydation of carbon and the oxydation of iron during blowing stage III
ΔSL change in the amount of slag in view of lime dissolved and iron burn-off
ΔQ change in the heat input and in the heat output during blowing stage III in view of oxydizing carbon, oxydizing iron, reducing the amount of crude steel and changing the resulting amount of slag.

17. Optimizing the flow of blowing oxygen during the blowing stage III according to an interation method results, when correctly establishing the slag balance, the iron balance, the oxygen balance and the heat balance, in the following final values.

| | | | |
|---|---|---|---|
| $v_{o(III)}$ | = | 390 $Nm^3$/min | (17) |
| $VO_{2(III)}$ | = | 148 $Nm^3$ | |
| $t_{(III)}$ | = | 0,38 min | |

18. The finally established amounts of charging materials are the following:

| | | | |
|---|---|---|---|
| MPI | = | 98.9 to pig iron | (18) |
| MSC | = | 30.2 to scrap | |
| MKA | = | 6420 kg lime | |
| total blowing time $t_g$ = 15.23 min | | | |

19. To assist a trouble-free and metallurgically optimal procedure, the positions of the lance and the time sequence of lance positions as well as the time-sequence of adding the additive materials are now being controlled according to the invention for a surface blowing refining process performed with oxygen

| | | |
|---|---|---|
| $L_{(I)}$ = 2,1 m | instant from starting: | (19a) |
| $L_{(II)}$ = 1,4 m | $t_{(II)}$=5.05 min | |
| $L_{(III)}$ = 1,5 m | $t_{(III)}$=14.85 min | |
| | instant from starting: | |
| fluor spar 200 kg | $t_Z$ = 0,5 min | |
| additional lime 1000 kg | $t_Z$=1.85 min | |

I claim:

1. In a blowing process for refining and producing steels having a carbon content ranging from 0.1 to 0.8% by weight, during which blowing process lime, ore and fluxes are added to the metal bath of the refining vessel to control the composition of the ultimate steel product, the improvement comprising undertaking said oxygen-blowing in two immediately successive stages, the amount of blowing oxygen being constant within each of said stages, wherein in the first of said stages, all of said lime, ore and fluxes are added and oxygen is supplied to said bath in an amount which is directly proportional to the Si and Mn content of pig iron in said bath and wherein the duration of said first stage is inversely related to the rate of oxygen flow; and in the second of said stages, the duration of the oxygen flow is inversely related to the rate of oxygen flow and the amount of oxygen in said second stage is sufficient to cause the slag to become saturated in both lime and dicalciumsilicate wherein the slag basicity is at least 2.8 and wherein a minimum slag content of 50 kg/ton of pig iron is maintained, while maintaining the concentration of P and Mn of the pig iron in said bath so that the ultimate steel product of the second stage has a maximum P content of 0.04% by weight and a minimum Mn content of 0.2% by weight.

2. The process as claimed in claim 1, characterized in that the specific flow of oxygen is maintained constant within a range of 150 to 350 $Nm^3$/h pig iron.

3. The process of claim 1, which includes a third oxygen-blowing stage, in which the metal bath composition of said second stage is immediately exposed to an amount of oxygen sufficient to produce a steel with a carbon content which is lower than the carbon content of the steel product which results from said second stage.

4. The process as claimed in claim 1, wherein oxygen is introduced during the first blowing stage for a period of $t_A$ wherein $t_A$ is defined by $$t_A = \frac{0.62.10^3}{VO_2} + 2{,}75 \cdot Si_R + 0.64 \cdot Mn_R + 0.43,$$

wherein $t_A$ is the duration in minutes of the first blowing stage, $VO_2$ is the specific flow of blowing oxygen expressed in $Nm^3$/h.t pig iron, $Si_R$ is the Si-content in percent of the pig iron and $Mn_4$ is the Mn-content in percent of the pig iron.

5. Process as claimed in claim 1, characterized in that adding of the additive material is being terminated at the latest after a time interval from starting the blowing process which is increasing with increasing oxygen flow, with increasing oxygen pressure and with increasing inner diameter of the refining vessel and which is decreasing with the nozzle diameter, with the number of nozzles and with the weight of the charge.

6. The process as claimed in claim 3, wherein oxygen is introduced by a lance, wherein the position of said lance is lowered closer to the surface of the bath between said first and second stages.

7. The process as claimed in claim 1, wherein said blowing process is a oxygen blowing process.

8. The process of claim 1, wherein the amount of oxygen which is supplied during each of said stages is increased, by controlling the position of a lance, which supplies the oxygen for said process, by lowering the lance closer to the surface of the bath.

9. The process as claimed in claim 3, wherein the third stage is begun at a time interval which is measured from the beginning of the second stage and which is designated as $$t_B = C_A - C_{Kr}/K_2)$$

wherein $t_B$ is the time interval in minutes from the beginning of the second stage to the beginning of the third stage; $C_A$ is the carbon content of the metal bath at the beginning of the second blowing stage; and $C_{Kr}$=0.206 ($VO_2$ 0.15) wherein $C_{kr}$ is the carbon content at the end of the second blowing stage and $VO_2$ is the specific rate of flow of blowing oxygen expressed as $NM^3$/h.t. pig iron, and $K_2$ is the decarburization velocity in the second blowing stage and is expressed in percent by weight per minute;

wherein oxygen blowing is terminated in the third stage at an interval $t_{B'}$, which interval is measured from the beginning of said second stage wherein $t_{B'}$ is defined according to the equation $$t_{B'} = (A - C_v/K_2)$$

wherein $C_v$ is the ultimate carbon content of the refined steel product and is greater than $C_A$, $C_A$ and $K_2$ having the meanings set forth above.

10. Process as claimed in claim 7, characterized in that, in a surface blowing process performed with oxygen, the lance is being lowered at the beginning of the second blowing stage to a distance which is being selected in dependence on the oxygen flow, the inner diameter of the refining vessel, the number of nozzles, the weight of the bath and the amount of the slag.

11. The process as claimed in claim 9, wherein the duration ($t_c$), as measured in minutes, of the third blowing stage is determined according to the following equation $$t_c = \frac{3{,}277.10^2}{vo_2^{0,85}} - \sqrt{\frac{1{,}0738.10^5}{vo_2^{1.7}} - \frac{4{,}128.10^5 \cdot (C_{kr} - C_v)}{vo_2^{1,85}}}.$$

12. The process as claimed in claim 3, wherein the lance position $L_2$ is selected at the beginning of the second blowing stage according to the equation $$L_2 = \left( -\frac{p}{2} + \sqrt{\left(\frac{p}{2}\right)^2 - q} \right) \cdot 10^2 \text{ m}$$

$$p = \frac{20 \cdot \sqrt{M_{St}}}{D_T} - 6 \cdot \sqrt{\frac{v_o}{N}}$$

$$q = \frac{10^2 \cdot M_{St}}{D_T^2} - \frac{60}{D_T} \cdot \sqrt{\frac{M_{St} \cdot v_o}{N}} + \frac{9 \cdot v_o}{N} - \frac{25 \cdot \frac{v_o}{N}}{\frac{0{,}05}{D_T} \cdot \sqrt{M_{St}} + \frac{M_{S1} \cdot 0{,}12}{D_T^2}}$$

in which $M_{S1}$ is the amount of slag in tons and the remaining variables have the meanings defined above.

13. The process as claimed in claim 11, wherein the rate of oxygen flow is directly dependent on the total oxygen requirement for refining a given amount of pig iron.

14. The process as claimed in claim 13, wherein the optimum flow of blowing oxygen for each individual charge is determined by the equation $$v_o = \frac{O_g - 5.528 \cdot M_{Re}}{A} + \frac{0.3785 \cdot M_{Re}^{0.85} \cdot v_{om}^{0.15} - C_R \cdot M_{Re}}{9{,}3 \cdot 10^{-2} \cdot ADVC \cdot A}$$

under the conditon $C_v < C_{kr}$
and determined by the equation $$v_o = \frac{O_g - 5.528 \cdot M_{Re}}{A} + \frac{(C_v - C_R) \cdot M_{Re}}{9.3 \cdot 10^{-2} \cdot ADVC \cdot A}$$

under the condition $C_v > C_{kr}$,
wherein $O_g$ is the total requirement in oxygen, $M_{Re}$ is the amount of pig iron, $$A = 1{,}471 \cdot Si_R + 0{,}342 \cdot Mn_R + 0{,}23 \text{ and } v_{om} = \frac{v_{omin} + v_{omax}}{2}$$

noting that $v_{omin}$ and $v_{omax}$ are the plant-specific limiting values for the flow of blowing oxygen and ADVC is an adaptation factor, which factor takes into account the effective decarburization velocity ($K_2$) of the second blowing stage.

15. The process as claimed in claim 6, wherein in a surface blowing process performed with oxygen, the distance of the lance from the surface of said bath during the first blowing stage is, substantially proportional to the narrowest cross-section of the nozzle, to the root of the number of nozzles and to the partial pressure of the oxygen.

16. The process as claimed in claim 15, wherein the lance position, during the first blowing stage, is calculated according to the equation $$L_1 = D_{kr}\sqrt{N} \cdot (-0.275 \cdot p_1^2 + 6.1 \cdot p_1 5.5) \cdot 10^{-3},$$

in which $L_1$ is the distance from the bath surface as measured in meters, and $D_{kr}$, N and $p_1$ have the above defined meanings.

17. The process as claimed in claim 12, wherein the lance is lowered at the beginning of the third blowing stage for a distance $$\frac{1.43.10^3 \cdot (C_{kr} - C_v)^{1.34}}{VO_2^{0.96} \cdot \frac{M_{St}}{D_T^2}}$$

expressed in meters.

18. The process as claimed in claim 4, wherein the second blowing stage is terminated at a carbon content of approximately $C_{kr} = 0.26$ ($VO_2$ 0.15).

19. The process of claim 14, wherein the amount of oxygen which is supplied during each of said stages, is controlled by controlling the position of a lance supplying the oxygen for said process, by lowering the lance closer to the surface of the bath.

20. The process as claimed in claim 12, wherein the lance is raised at the beginning of the third blowing stage for a distance $$\frac{1.43.10^3 \cdot (C_{kr} - C_v)^{1.34}}{VO_2^{0.96} \cdot \frac{M_{St}}{D_T^2}}$$

expressed in meters.

21. The process as claimed in claim 1, wherein the instant for terminating the addition of additive materials is determined according to the following equation $$T_1 = t_g \cdot \frac{1.210^2 \cdot v_o \cdot D_T^4}{\sqrt{N^3} \cdot M_{St}^2 \cdot D_{kr} \cdot (-0.275 \cdot p_1^2 + 6{,}1 \cdot p_1 - 5.5)},$$

in which $T_1$ is the maximum duration, measured in minutes from the very beginning of the blowing process, for adding the additive materials, $t_g$ is the total blowing time as measured in minutes, $v_o$ is the flow of blowing oxygen in $Nm^3$/min, $D_t$ is the inner diameter of the refining vessel as measured in meters, N is the number of nozzles, $M_{St}$ is the amount of crude steel in tons, $D_{kr}$ is the narrowest diameter of the nozzle as measured in millimeters and $p_1$ is the oxygen pressure as measured in atmospheres.

* * * * *